US005535579A

United States Patent [19]

Berry, III et al.

[11] Patent Number: 5,535,579

[45] Date of Patent: Jul. 16, 1996

[54] METHOD AND APPARATUS FOR CONTROLLING TAKEUP TENSION ON A STRANDED CONDUCTOR AS IT IS BEING FORMED

[75] Inventors: William M. Berry, III; Michael F. Flagg, both of Coweta County; Bobby C. Gentry; James L. Rhyne, both of Carroll County, all of Ga.

[73] Assignee: Southwire Company, Carrollton, Ga.

[21] Appl. No.: 184,407

[22] Filed: Jan. 21, 1994

Related U.S. Application Data

[63] Continuation of Ser. No. 876,307, Apr. 30, 1992, abandoned.

[51] Int. Cl.[6] ..... D01H 7/90; D01H 7/86

[52] U.S. Cl. ..... 57/13; 57/58.49; 57/58.86; 57/93; 57/264; 57/314

[58] Field of Search ..... 57/264, 13, 314, 57/58.49, 58.86, 93; 242/45

[56] References Cited

U.S. PATENT DOCUMENTS

| | | | |
|---|---|---|---|
| B 492,373 | 3/1976 | Patterson | 242/45 X |
| 2,571,023 | 10/1951 | Ertner | 242/45 |
| 3,566,596 | 3/1971 | Pennycuick et al. | 57/264 X |
| 4,087,956 | 5/1978 | Gre | 57/58.86 X |
| 4,381,852 | 5/1983 | Ferree et al. | 242/45 X |
| 4,389,838 | 6/1983 | Adelhard et al. | 57/71 |

FOREIGN PATENT DOCUMENTS

| | | | |
|---|---|---|---|
| 3934605 | 4/1991 | Germany | 57/314 |

*Primary Examiner*—Daniel P. Stodola
*Assistant Examiner*—William Stryjewski
*Attorney, Agent, or Firm*—Stanley L. Tate; James W. Wallis, Jr.

[57] ABSTRACT

Method and apparatus for providing proper tension on a stranded conductor, as the conductor is formed and collected on a take-up reel or bobbin, by using a strain gage to monitor the tension of the conductor being collected and to provide a signal to a controller which in turn increases or decreases the speed of a direct current, variable speed, motor used to drive the take-up reel or bobbin, thereby providing proper tension to the conductor being collected.

5 Claims, 1 Drawing Sheet

FIG. 1 (PRIOR ART)
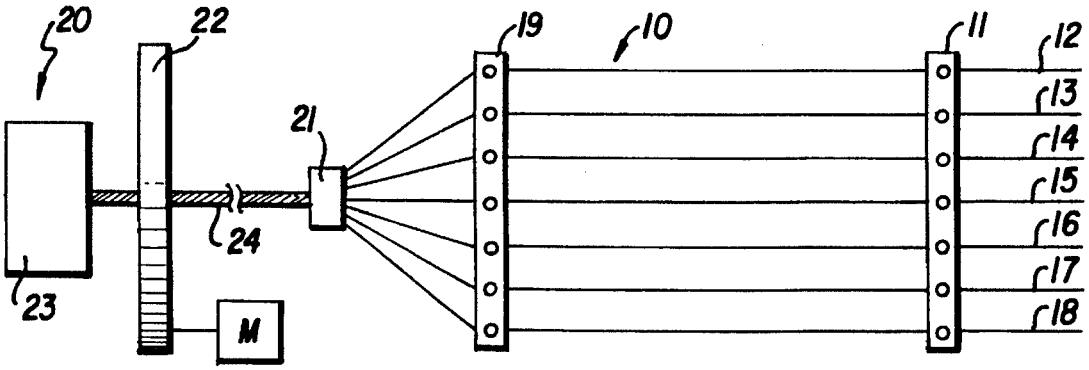
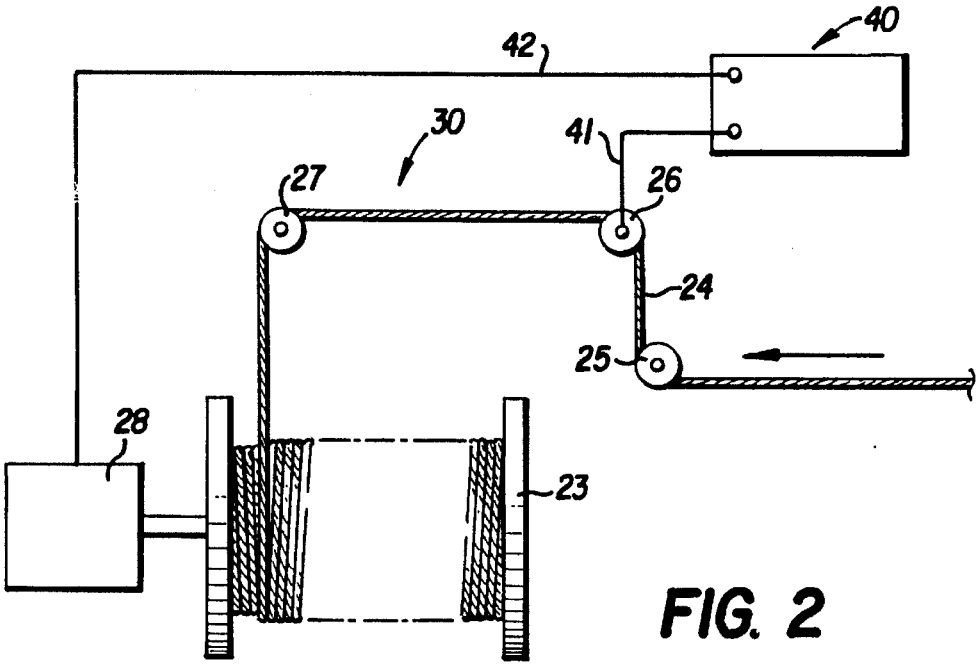
FIG. 2

METHOD AND APPARATUS FOR CONTROLLING TAKEUP TENSION ON A STRANDED CONDUCTOR AS IT IS BEING FORMED

This is a continuation of application Ser. No. 07/876,307 filed on Apr. 30, 1992, now abandoned.

FIELD OF THE INVENTION

This invention relates to an improved method and an apparatus for forming a stranded conductor on a double twist strander. More particularly, this invention relates to an improved method and apparatus for providing a constant tension on a stranded and formed conductor as the conductor is collected on a reel or bobbin after the conductor is formed on a double twist strander.

BACKGROUND

Stranded electrical conductors fabricated with a plurality of round wires made of an electrically conductive metal, such as copper or aluminum, are well known in the art, as are methods and apparatus for making these stranded conductors. Such conductors are customarily fabricated by stranding together a plurality of wires in concentric layers about a core wire. As used herein, the term "core wire" includes a single core wire as well as a stranded conductor used as a core wire for a second or subsequent layer of wires. The natural geometry of such a construction is that when round wires of the same diameter are used to form a stranded conductor, six wires naturally fit around a single core wire of the same diameter, twelve wires fit naturally around the layer of six wires, eighteen wires fit around the layer of twelve wires and so on with each successive layer containing six wires more than are contained in the layer around which they are being stranded. Conductors of this configuration are known as concentric lay conductors. The number of individual wires contained in any conductor having "n" layers of wire about a core wire of a common diameter is calculated by the algebraic equation $X=6(n)+1$; with "X" being the number of wires in the conductor and "n" being the number of layers of wire about the center or core wire.

Generally speaking, there are three conventional types of apparatus for making stranded electrical conductors which have a plurality of round wires twisted about the longitudinal conductor axis. One apparatus, known as a rigid frame strander, employs a rotating pay-out system. In a rigid frame strander, a plurality of spools of wire are mounted on a rotatable laying head through which a core wire passes. As the laying head is rotated, the wires from the plurality of spools are helically wrapped or twisted about the advancing core wire and passed through a closing die to form a stranded conductor which is then collected on a take-up reel or bobbin. One of the main disadvantages of this type of strander is the slow speeds at which the apparatus must be operated.

A second type of apparatus employs a rotating take-up reel in which the take-up reel is rotated about two axes, namely, the reel axis for take-up purposes and the conductor axis to provide twists to the conductor. In this second type of apparatus, a plurality of wires are advanced in substantially side-by-side relation from a plurality of spools or stem packs mounted on a stationary platform. The wires are guided to a stationary lay plate. One of the wires passes as a core wire and the remaining wires are concentrically spaced about the core wire. The wires are passed from the lay plate to a closing die and thence to a take-up reel which twists the stranded conductor.

The third known type of apparatus for making stranded cable is a strander, e.g., a double twist strander, in which the wires are advanced from stationary spools in side-by-side relation through a stationary twist plate and to a closing die. In the strander, however, neither the pay-out system nor the take-up system rotates about the axis of the conductor. A twist is applied to the wires of the stranded conductor by a rotating bow mechanism located between the closing die and the take-up reel. Advantageously, the double-twist strander is a more efficient and economical apparatus than either the rigid frame strander with a rotating pay-out system or the apparatus with a rotating take-up reel because the double twist strander provides two twists in the stranded conductor for each revolution of the rotating bow. Thus, for a given speed of rotation, the production rate of a double twist strander is almost twice the production rate of the machines with a rotating pay-out or take-up system. Moreover, the double twist strander is a more compact system because the pay-out spools and the take-up reel need not be mounted for rotation as they must in other types of stranding apparatus.

Of primary concern when forming a stranded conductor on a double twist strander is the need for uniform tension on the stranded conductor as it is being collected on the take up reel. Uniform tension is required to prevent any of a number of undesirable events from taking place.

Absent adequate and uniform tension, a conductor bunched and then twisted by the double twist strander will contain wires that do not lay substantially flat about the core wire. This condition is known as a "high wire" in the conductor. This high wire cannot be properly insulated, nor will it maintain its position in the conductor if the conductor is used bare. High wires spawn a loose cable configuration that will not maintain its lay during use.

Inadequate and non-uniform tension on the conductor being collected also contributes to a condition known as "cross over". Cross over occurs when the conductor is placed on the reel and a previously placed wrap of wire slides across the layers of wire and crosses over the top of the wraps subsequently placed and tension is then applied. This condition results in a binding of the latter wrap by the previous wrap. When attempting to remove the conductor from the reel, tangles will result at the point where the cross over is found. Additionally, if sufficient tension is applied when paying off the conductor, the binding at the cross over can actually contribute to plastic tensile deformation, thereby resulting in neckdowns in the cross section of the conductor. In extreme cases, the conductor may actually break from the tension at the cross over.

Another advantage of adequate and uniform tension is that the wire can be "even wound" about the reel or bobbin. This is especially necessary when the stranded conductor is to be removed from the reel by "flipping". Flipping consists of laying the reel on one of its two flanges. The wire is paid off the bobbin as it flips off the arbor and around the top flange. If the reel was filled with conductor having non uniform or inadequate tension, the wraps will be loose and will prematurely release and fall about the arbor near the bottom flange. As wraps fall, they cross over other wraps and the problems associated with cross over, as set out above, occur.

Typical industry practice is to apply back tension to the conductor as it is being collected on the take-up reel or bobbin. This tension is typically provided by some type of resistance clutch driving the take-up. The disadvantage to using resistance clutches is that they are generally incapable of precise adjustment and even less capable of continuous adjustment as the conductor is being formed and collected and the tension requirements change. As a result, most clutches are adjusted so that they provide suitable tension for a full bobbin or reel. With the tension so adjusted, the tension is too great when the bobbin or reel is near empty.

It is this need to provide continuously variable, precisely adjustable, tension to the conductor, after it has been twisted and as it is being collected, that is addressed by the present invention.

SUMMARY OF THE INVENTION

The present invention provides a method and an apparatus for precisely adjusting the back tension applied to a stranded conductor after the conductor has been formed and as it is being collected on a reel or bobbin. Hereinafter, the use of reel or bobbin will be implied if either reel or bobbin is set out.

Unlike a typical strander which uses a single source of power to drive both the twisting portion of the strander as well as the take-up function, the present invention uses a main power source to drive the twisting portion of the strander and it uses a smaller, independently controlled, variable speed, direct current, motor to drive the take up reel. By controlling the reel take up speed, you thereby control the tension that the reel exerts on the conductor being collected thereon. The means for independently controlling the speed of the direct current, variable speed motor that drives the take-up reel is a strain gage which directly measures the tension on the conductor being collected and signals the reel drive motor by way of a controller unit.

BRIEF DESCRIPTION OF THE DRAWINGS

FIG. 1 is a schematic side elevation view of a double twist strander;

FIG. 2 is a schematic side view of the present invention showing its position relative to the elements of a typical strander;

DETAILED DESCRIPTION OF THE INVENTION

Refer now to FIG. 1, which is a schematic side elevation view of a double twist strander. Strander apparatus, designated generally by reference numeral 10, is of conventional design but has been modified so as to include elements of the present invention, the elements shown more particularly in FIG. 2. In its simplest configuration, a plurality of round wires 12, 13, 14, 15, 16, 17, 18 comprising seven wires, having substantially the same diameters, are withdrawn from a respective spool or bobbin (not shown) in a generally horizontal direction to a guide plate 11 of strander apparatus 10 and through which one of the wires 15 is guided into a common horizontal plane. Wire 15 is the core wire and is passed through a central opening (not shown) of stationary twist plate 19 of strander apparatus 10. Wires 12–14 and 16–18 are passed through openings (not shown) in twist plate 19 of strander apparatus 10. The seven wires 12–18 are then guided through twist plate 19 and through a closing die 21 where the wires are converged onto the outer surface of core wire 15. The wires are twisted and collected by a conventional take-up system 20 comprising a rotating bow 22 which rotates about the axis of conductor 24, to twist the same and a take-up reel 23 which rotates only about a horizontal axis transverse to the longitudinal axis of strander 10 to take-up stranded conductor 24.

Refer now to FIG. 2, which is a schematic side view of the present invention showing the position of its elements relative to the elements of a typical strander. The process of forming the conductor 24 is set out hereinabove and is common to using the present invention. After conductor 24 has been formed, but before it is collected on reel 23, it is directed around guide 25, around strain gauge 26, and over guide 27. Take-up reel 23 is driven by variable speed, direct current drive motor 28. Tension is placed on wire 24 as it passes under guide 25, over strain gauge 26, over guide 27, and is collected by driven reel 23. If given that the rate of forming conductor wire 24 is constant, then the faster take-up reel 23 tries to turn, the greater the tension applied to conductor wire 24. In the typical take-up (not shown) a preset tension is applied, through some type of slip clutch, so as to insure that the reel will provide adequate tension on the wire when the reel is full. As earlier stated, this is excess tension when the reel is empty. In the present invention, as reel 23 is driven by motor 28, tension is applied to conductor wire 24 as reel 23 pulls conductor wire 24 against guide 27 which in turn pulls it, wire 24, against strain gauge 26. Strain gauge 26 sends an electronic signal to a controller 40 which compares the signal against a preset null position. The controller 40 sends an electronic signal to variable speed, direct current motor 28, directing it, motor 28, to either slow down if the tension is too great, or to speed up if the tension is too little.

If the tension on conductor wire 24 is too little, the signal sent to drive motor 28 is to speed up. As motor 28 speeds up, wire 24 is pulled tighter against guide 27 and strain gauge 26. Strain gauge 26 senses the increased tension and sends subsequent signals to controller 40. Each time controller 40 receives a signal from gauge 26, a comparison is made to the null setting. Controller 40 continues to send signals to motor 28 until a tension is reached which corresponds to the selected preset tension.

If too much tension is detected on wire 24, the exact opposite series of actions and reactions occur until proper tension is obtained.

It is this continuous measure, compare, adjust, measure, compare, adjust cycle which eliminates many of the disadvantages of other mechanical and magnetic slip-clutch type tension control systems; and, it is through implementing strain gauge 26 and controller 40 that this precisely adjustable system is driven.

Although the invention has been discussed and described with primary emphasis on one embodiment, it should be obvious that adaptations and modifications can be made for other systems without departing from the spirit and scope of the invention.

What is claimed is:

1. A double twist strander apparatus for fabricating and collecting a stranded conductor, said conductor having a core wire and a plurality of wires surrounding said core wire, comprising:

means for delivering said core wire and said plurality of wires to said double twist strander;

means for twisting said plurality of wires about said core wire to form said stranded conductor, said twisting means including a rotatable bow driven by a first drive means;

reel means for taking-up said stranded conductor;

a second drive means operatively independent of said first drive means comprising a variable speed motor directly driving the reel means for rotating the reel means at the rotational speed of the motor such that the rotational :speed of the reel means varies with the speed of the motor;

means for guiding said stranded conductor onto said reel means;

means for detecting the tension of said stranded conductor upstream of said guiding means as said conductor is collected on said reel means and for generating a signal corresponding to the, tension detected in said conductor; and control means connected between said detecting means and said second drive means and responsive to said signal for controlling the rotational speed of said motor.

2. The apparatus of claim 1, wherein said means for detecting tension of said stranded conductor is a strain gauge.

3. The apparatus of claim 1, wherein said variable speed motor is a direct current drive motor.

4. A method for fabricating and collecting a stranded conductor on a double twist strander, said conductor having a core wire and a plurality of wires surrounding said core wire, comprising the steps of:

delivering said core wire and said plurality of wires to said double twist strander;

twisting said plurality of wires about said core wire at said double twist strander at a rotatable bow operatively driven by a first drive means to form said stranded conductor;

guiding said stranded conductor to a reel by a guiding means:

taking-up said stranded conductor on to said reel;

rotating said reel during the taking-up step by directly driving said reel with a second drive means having a variable speed motor operating at the rotational speed of said motor such that the rotational speed of the reel varies with the variable speed of the motor, said second drive means operating independently of said first drive means;

detecting the tension in said stranded conductor upstream of said guiding means as said conductor is collected on said reel during the taking-up step; and controlling the rotational speed of said variable speed motor during the taking-up step as a function of the detected tension.

5. The method of claim 4, including the additional step of controlling the rotational speed of said motor so as to provide a predetermined back tension on said conductor as said conductor is collected.

* * * * *